US010697720B2

(12) United States Patent
Silva

(10) Patent No.: US 10,697,720 B2
(45) Date of Patent: Jun. 30, 2020

(54) PROJECTILE LAUNCHER

(71) Applicant: Everson Fortes Silva, Tampa, FL (US)

(72) Inventor: Everson Fortes Silva, Tampa, FL (US)

( * ) Notice: Subject to any disclaimer, the term of this patent is extended or adjusted under 35 U.S.C. 154(b) by 0 days.

(21) Appl. No.: 16/177,582

(22) Filed: Nov. 1, 2018

(65) Prior Publication Data

US 2020/0141672 A1 May 7, 2020

Related U.S. Application Data

(60) Provisional application No. 62/580,987, filed on Nov. 2, 2017.

(51) Int. Cl.
*F41A 1/04* (2006.01)

(52) U.S. Cl.
CPC ..... *F41A 1/04* (2013.01)

(58) Field of Classification Search
CPC ..... F41A 1/04; F41A 7/04; F41A 7/08; F41B 11/00; F41B 11/12
USPC ..... 124/73, 74, 63, 65; 89/7
See application file for complete search history.

(56) References Cited

U.S. PATENT DOCUMENTS 3,800,657 A * 4/1974 Broxholm ..... F41A 1/04 89/7
3,915,057 A * 10/1975 Broxholm ..... F41A 1/04 89/7
3,949,642 A * 4/1976 Broxholm ..... F41A 1/04 89/7
4,062,266 A * 12/1977 Elmore ..... F41A 1/04 89/7
7,730,881 B1 * 6/2010 Pedicini ..... F04B 9/02 124/65
9,222,737 B1 * 12/2015 Lund ..... F41A 1/04
2004/0144012 A1 * 7/2004 Adams ..... F41A 1/04 42/106
2005/0000505 A1 * 1/2005 Pedicini ..... F04B 9/02 124/63
2006/0032487 A1 * 2/2006 Tippmann ..... F41A 1/04 124/74
2009/0056693 A1 * 3/2009 Pedicini ..... F41B 11/64 124/73
2010/0313742 A1 * 12/2010 Silva ..... F41A 1/04 89/7
2011/0232618 A1 * 9/2011 Gabrel ..... F41B 11/723 124/73

(Continued)

*Primary Examiner* — Michael D David
(74) *Attorney, Agent, or Firm* — Robert M. Schwartz

(57) ABSTRACT

A projectile launcher, comprising: an internal tank configured to receive a combustible gas through an inlet, a barrel, a projectile storage portion, a piston, a trigger assembly configured to operate a spool, and a flexible structure configured to wrap around the spool. The flexible structure may be connected to the piston, wherein pulling the trigger assembly causes the spool to rotate to cause the flexible structure to pull the piston forward. The piston may be configured to expand a combustion chamber behind the piston when pulled forward, wherein pulling the trigger assembly causes the combustible gas to enter the combustion chamber created by the piston moving forward. The combustion chamber is configured to collapse after the shot is executed due to a spring bias applied to the piston to a backward position and due to the flexible shaft being released from pulling the piston forward.

2 Claims, 16 Drawing Sheets

(56) References Cited

U.S. PATENT DOCUMENTS

2013/0255525 A1* 10/2013 Silva ..... F42B 8/26
102/498

* cited by examiner

PROJECTILE LAUNCHER

CROSS-REFERENCE TO RELATED APPLICATION

This application claims the benefit of U.S. Provisional Patent Application Ser. No. 62/580,987, filed Nov. 2, 2017, which is incorporated herein in its entirety.

FIELD OF THE INVENTION

The present disclosure relates to projectile launchers, and more particularly to an improved projectile launcher that is powered by combustion.

BACKGROUND OF THE INVENTION

Projectile launchers are devices such as paintball markers or airsoft guns, and they are configured to launch projectiles. For example, paintball markers are devices that shoot paintballs. Projectile launchers may be used in recreational or military training settings.

Currently existing projectile launchers require a large tank of gas attached externally, which is cumbersome and annoying to a user. For example, such external tanks may be knocked during a paintball match, or have to be inconveniently replaced during the match.

Some paintball markers use combustion to launch projectiles. Combustion is preferable in paintball markers because it releases a great deal of energy compared to common non-combustive expansion gas systems. But, currently existing combustion paintball markers are inefficient and have a host of issues including thermal problems. Further, existing combustion markers require manual bolt operation to load each projectile, to accommodate the thermal problems associated with self-loading.

Therefore, there exists a need for an improved projectile launcher that effectively manages heat and has an ergonomic profile without requiring an external tank attachment.

SUMMARY OF THE INVENTION

This summary is provided to introduce a selection of concepts in a simplified form that are further described below in the detailed description. This summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

In one example, disclosed is a projectile launcher, comprising: an internal tank configured to receive a combustible gas through an inlet, a barrel, a projectile storage portion, a piston, a trigger assembly configured to operate a spool, a flexible structure configured to wrap around the spool, the flexible structure being connected to the piston, wherein pulling the trigger assembly causes the spool to rotate to cause the flexible structure to pull the piston forward, wherein the piston is configured to expand a combustion chamber behind the piston when pulled forward, wherein pulling the trigger assembly causes the combustible gas to enter the combustion chamber created by the piston moving forward, wherein pulling the piston forward loads a projectile into the barrel from the projectile storage portion in response to pulling the trigger, wherein gas in the combustion chamber is ignited while the piston is pulled forward, and igniting the gas causes a pulse to travel through the piston for executing a shot by launching the projectile through the barrel, wherein the combustion chamber is configured to collapse after the shot is executed due to a spring bias applied to the piston to a backward position and due to the flexible shaft being released from pulling the piston forward, and wherein collapsing the combustion chamber causes hot gas generated from the shot to be released. The gas may be green gas.

As another example, disclosed is a projectile launcher, the projectile launcher comprising, a 3-way solenoid valve, an internal tank configured to receive a combustible gas through an inlet, the internal tank in communication with the 3-way solenoid valve, a volume-adjustable reservoir in communication with the 3-way solenoid valve, an injection port in communication with the 3-way solenoid valve, a barrel, a projectile storage portion, a trigger, a trigger switch operatively connected to an electronic circuit board, a piston, the piston including a one-way valve at its back end, a spool, a motor configured to apply rotational force to the spool, a flexible structure configured to wrap around the spool, the flexible structure attached to the piston, an end cap at a back of the projectile launcher opposite the barrel, a return spring compressing the piston backward toward the end cap, forcing the spool and flexible structure toward initial positions, wherein when a user pulls the trigger, the trigger switch is activated to inform the electronic circuit board that the trigger has been pulled, wherein when a user pulls the trigger, the electronic circuit board sends an electrical pulse to the 3-way solenoid valve to cause gas stored in the volume-adjustable reservoir to pass to a space between the piston and the end cap, and concurrently, the motor rotates the spool to spool the flexible structure around the spool which causes the piston to be pulled forward toward the barrel to expand a combustion space behind the piston, where the combustion space receives gas through the 3-way solenoid valve by way of the injection port, wherein causing the piston to be pulled forward by the flexible structure compresses the return spring, wherein when the piston moved forward its one way valve blocks air passage through the piston to create a vacuum behind the piston for sucking air through an air inlet for mixing the air with the gas received through the 3-way solenoid valve, wherein moving the piston forward causes a bolt to load a projectile into the barrel, wherein a spark switch is activated to cause the electronic circuit board to send an electrical pulse to generate a spark to ignite the gas and air in the combustion chamber, wherein igniting the gas and air in the combustion chamber generates a pulse of pressure that travels through the one-way valve of the piston to propel a loaded projectile, and wherein after a shot the electronic circuit board cuts power to the motor, causing the return spring to push the piston back to an idle position to cause remaining gas in the combustion chamber to be exhausted through the piston valve through the barrel, and wherein as the piston moves back it pulls the flexible shaft and unspools the flexible shaft from the spool, causing the spool to return to an idle position.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

LIST OF REFERENCE CHARACTERS

Figure 1:
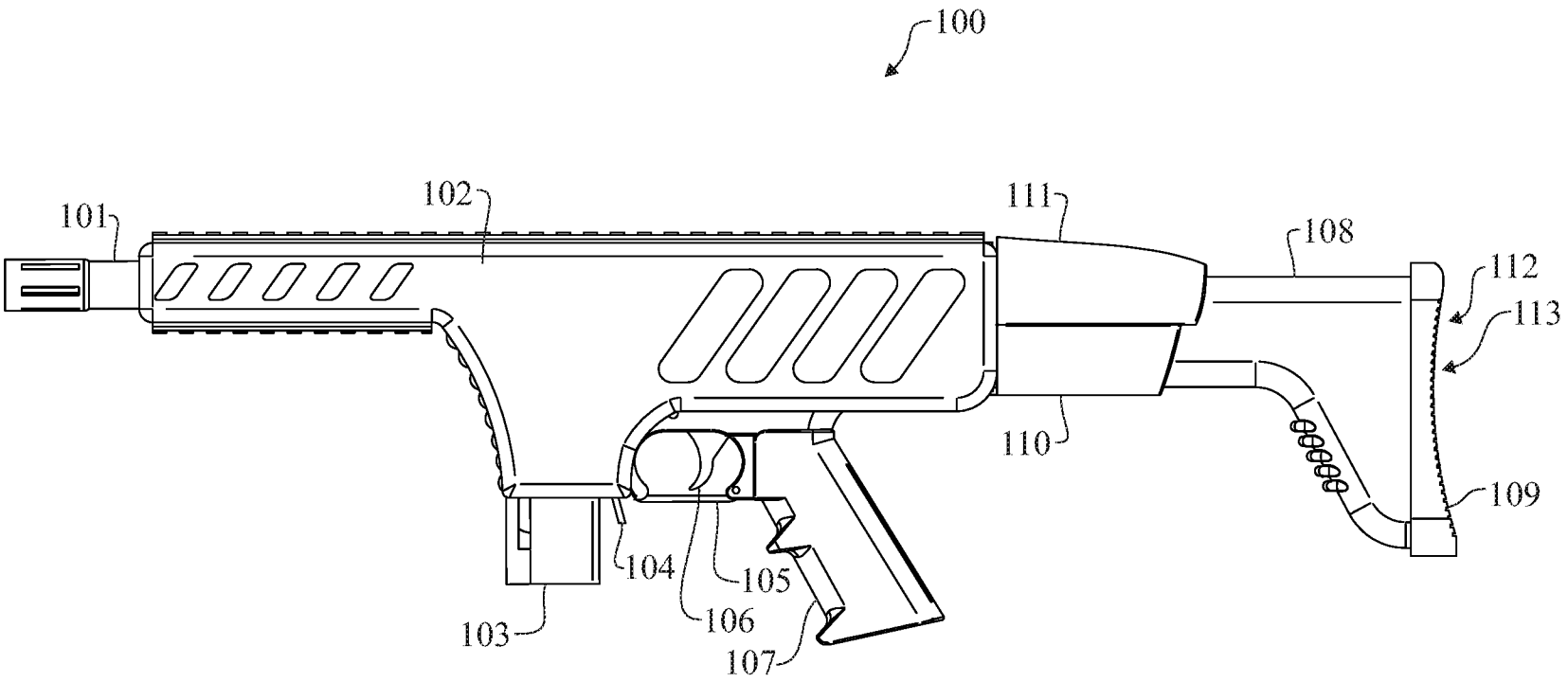
FIG. 1 shows a left side view of one embodiment of a paintball marker with protective covers.

100 example embodiment
101 barrel
102 covers
103 magazine for projectile storage
104 magazine release lever
105 trigger guard
106 trigger
107 handle
108 buttstock
109 buttstock cushion
110 buttstock lower cover
111 buttstock upper cover
112 green gas refill inlet
113 reservoir volume adjusting screw access hole
114 green gas can
115 Allen key
116 main body
117 projectile receiver
118 DC geared motor
119 hi voltage unit
120 gear box assembly
121 projectile
122 bolt guide
123 rechargeable battery pack
124 internal green gas reservoir
125 gas injection port
126 conduit from the 3-way solenoid valve to the adjustable volume reservoir
127 conduit from the internal green gas reservoir to the 3-way solenoid valve
128 3-way solenoid valve
129 conduit from the exit of 3-way solenoid valve to the gas injection port
130 electronic circuit board
131 hi voltage cable
132 end cap
133 end cap valve membrane
134 piston
135 return spring
136 power tube
137 bolt
138 power tube washer
138 power tube spring
140 spark plug
141 piston O-ring
142 piston valve O-ring
143 double O-ring bumper
144 end cap O-ring
145 flexible shaft
146 guiding pulley
147 spool
148 bolt O-ring
149 sector gear
150 dc motor bevel gear
151 trigger switch
152 end cap valve membrane screw
153 combustion chamber
154 spark switch
155 ball bearings
156 bevel gear
157 pinion gear
158 shaft
159 stopper
160 stopper plate
161 volume adjustable reservoir body
162 reservoir volume adjusting screw
163 volume adjustable reservoir O-ring
164 volume adjustable reservoir stopping plate
165 volume adjustable reservoir conduit connector
166 main body bushing
167 large pulley shaft
168 main body air inlet
169 metering space
200 volume adjustable reservoir

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

FIG. 1 shows a left side view of one embodiment of a paintball marker 100. The marker 100 includes a barrel 101 which is secured by threads to a receiver (117 in FIG. 6). The receiver may be adapted to receive projectiles from many feeder devices such as paintball hoppers or, as shown in FIG. 1, a magazine 103 which can receive balls or shaped projectiles such as First Strike Paintballs. In this embodiment, the magazine 103 can be released from the marker 100 by depressing the magazine release lever 104. The internal parts are protected by a cover 102 which can be made from one material or layers of different materials to insulate an exterior part of the marker from heat generated by combustion. Also attached to the marker 100 is a handle 107 which includes a trigger guard 105 and an electronic circuit board (130 in FIG. 9). The marker 100 uses a buttstock 108 which encases an internal green gas reservoir 124, a 3-way solenoid valve 128, and a battery pack 123. In another embodiment, these components can be moved to inside of cover 102, eliminating the buttstock 108.

Figure 2:
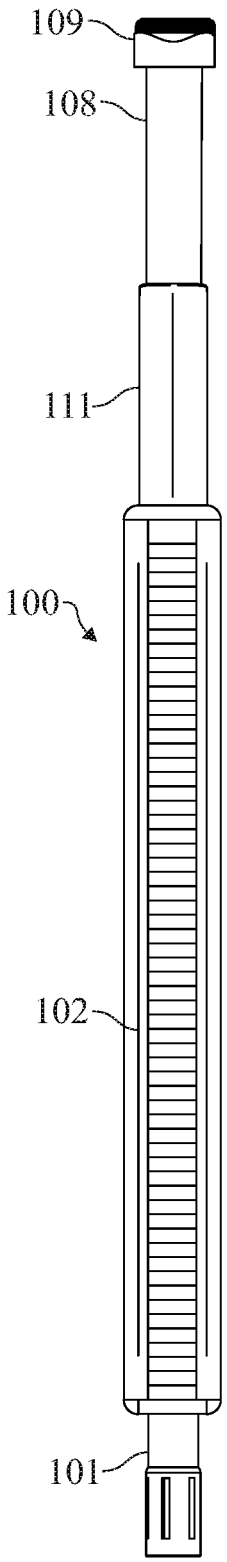
FIG. 2 shows a top view of the embodiment of FIG. 1 with protective covers.

FIG. 2 shows the top view of the embodiment of FIG. 1.

Figure 3:
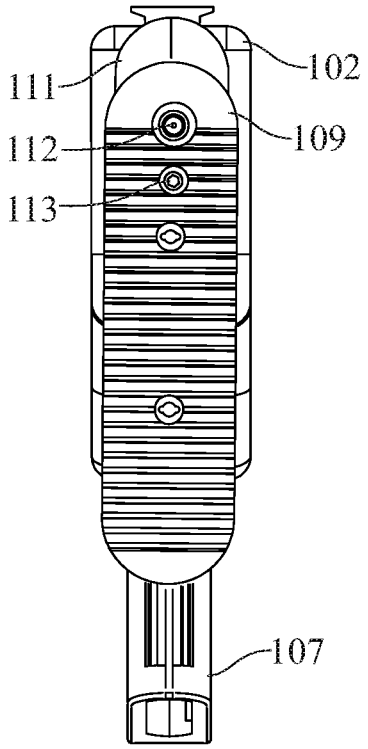
FIG. 3 shows a back view of the embodiment of FIG. 1.
Figure 22:
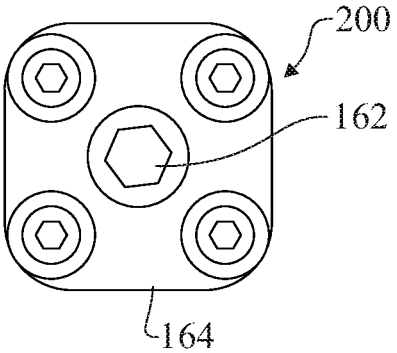
FIG. 22 shows a back view of the volume adjustable reservoir.
Figure 23:
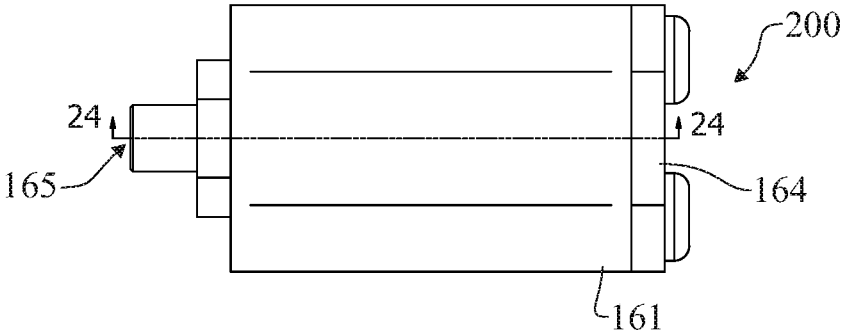
FIG. 23 shows a left side view of the volume adjustable reservoir.

FIG. 3 shows the back side of the marker 100, and shows the buttstock cushion 109 with holes to access the internal green gas reservoir 124, and a reservoir volume adjusting screw (162 in FIG. 22) which is used to adjust the amount of green gas that will be injected in the marker 100 by way of the 3-way solenoid valve 128.

Figure 4:
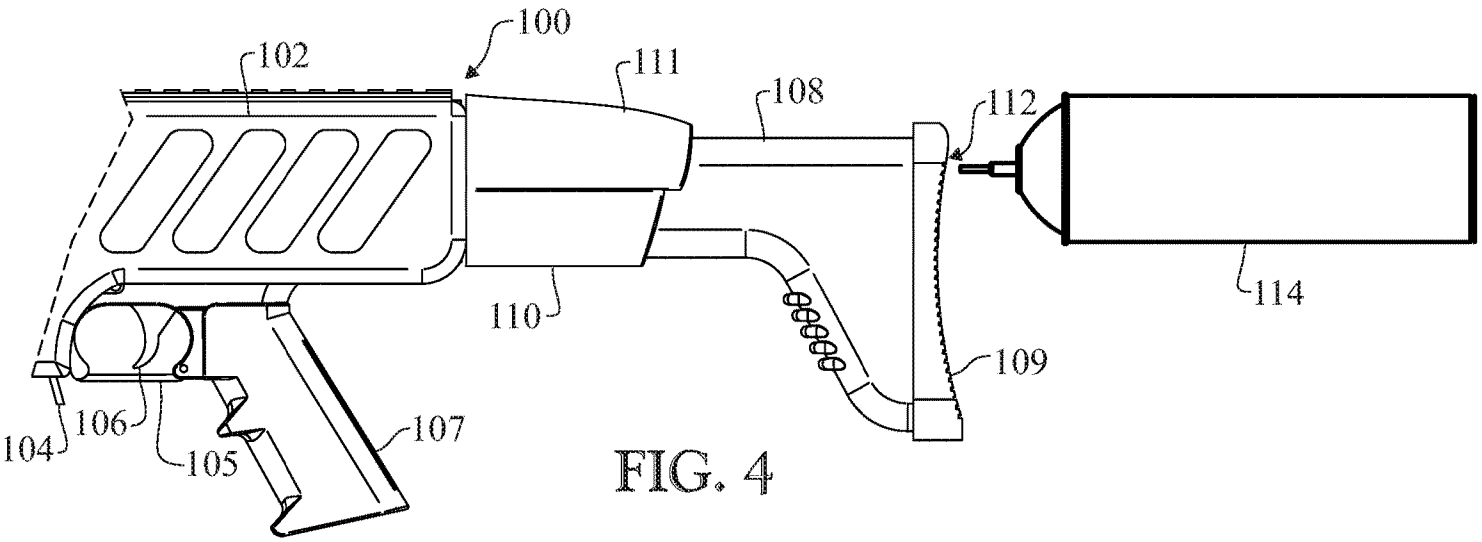
FIG. 4 shows a partial side view of the embodiment of FIG. 1 with a can of green gas in a refilling position, aligned with a green gas refill inlet.

FIG. 4 shows the marker 100 in position to be refilled using a green gas can 114. To refill the internal green gas reservoir 124, the user will press the green gas can 114 into the green gas refill inlet 112 for about 5 seconds, transferring gas from the green gas can 114 to the internal green gas reservoir 124, providing enough green gas to shoot hundreds of projectiles.

Figure 5:
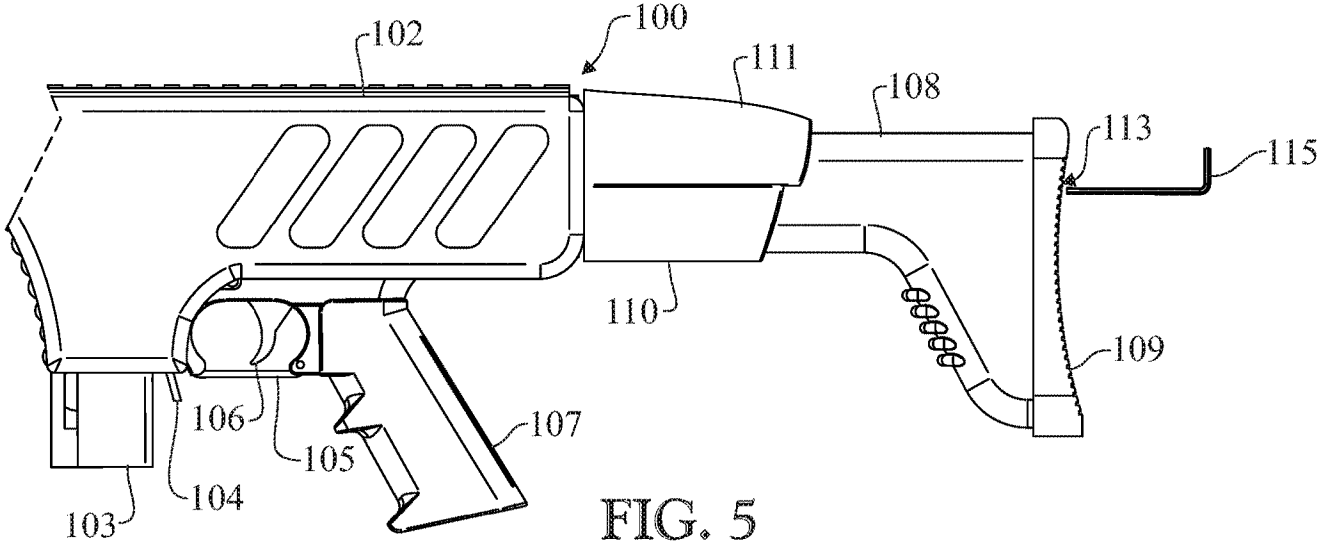
FIG. 5 shows a partial side view of the embodiment of FIG. 1 with an Allen key in position to adjust the reservoir volume adjusting screw.

FIG. 5 shows the marker 100 and an Allen key that will be used to adjust the volume adjustable reservoir 200, and in this way controlling the amount of green gas that the 3-way solenoid valve 128 will inject in the chamber to be ignited. More detailed description of this is in detailed description of drawings, FIG. 24.

Figure 6:
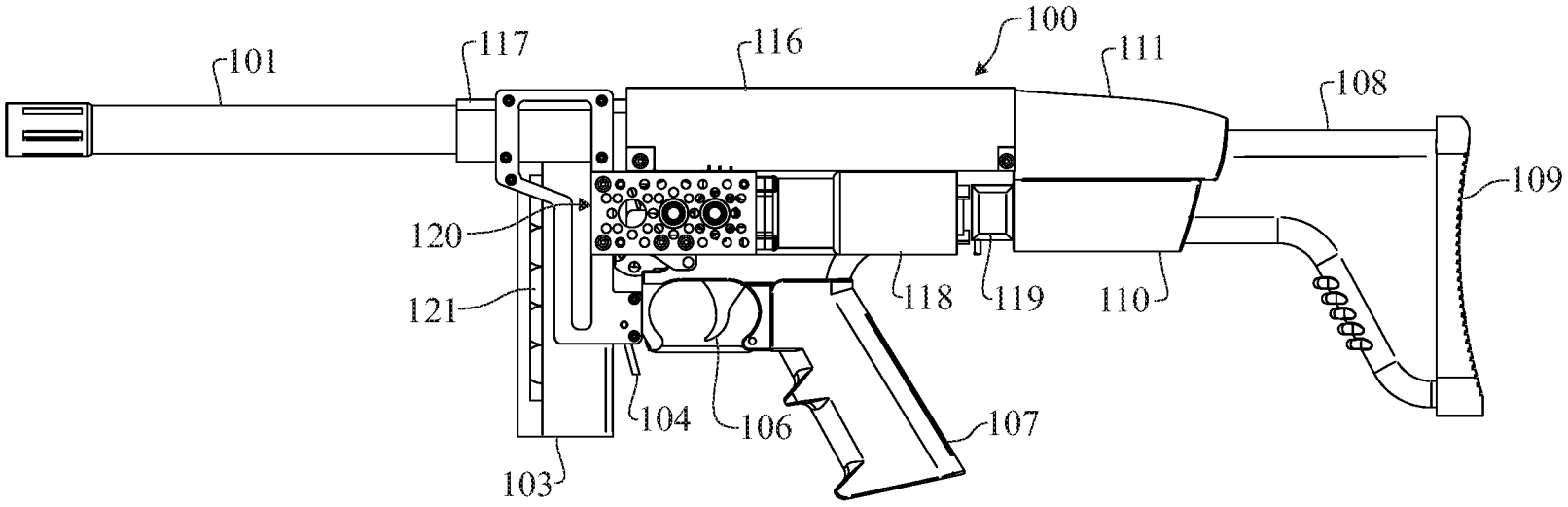
FIG. 6 shows a left side view of one embodiment of FIG. 1 without protective covers.

FIG. 6 shows the left side view of the embodiment of FIG. 1, without protective cover 102. The marker 100 includes a barrel 101 which is secured by threads to a receiver 117. Attached to the back side of receiver 117 is a bolt guide (122 in FIG. 8) which extends to inside of the main body 116 and is secured by a main body bushing 166 which is designed to secure the bolt guide 122 and to secure the guiding pulley 146 without blocking the front opening of the main body 116 allowing air to circulate inside. A DC geared motor 118 is used in this embodiment, but in another embodiment, a step motor or a servomotor can be used.

Figure 7:
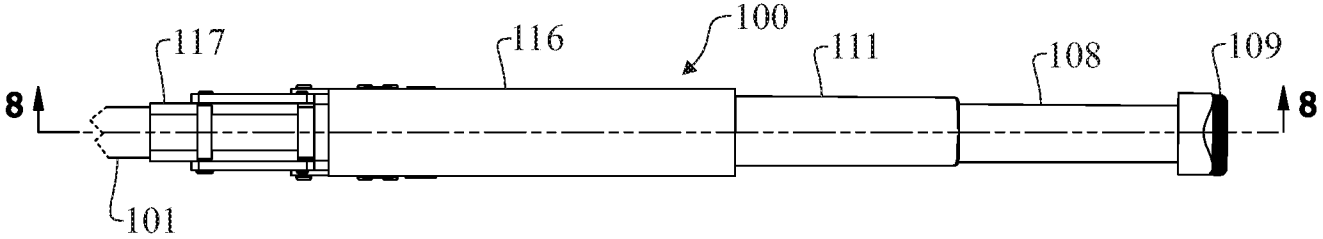
FIG. 7 shows a top view of the embodiment of FIG. 1 without protective covers.

FIG. 7 shows a top view of FIG. 1, without protective cover 102.

Figure 8:
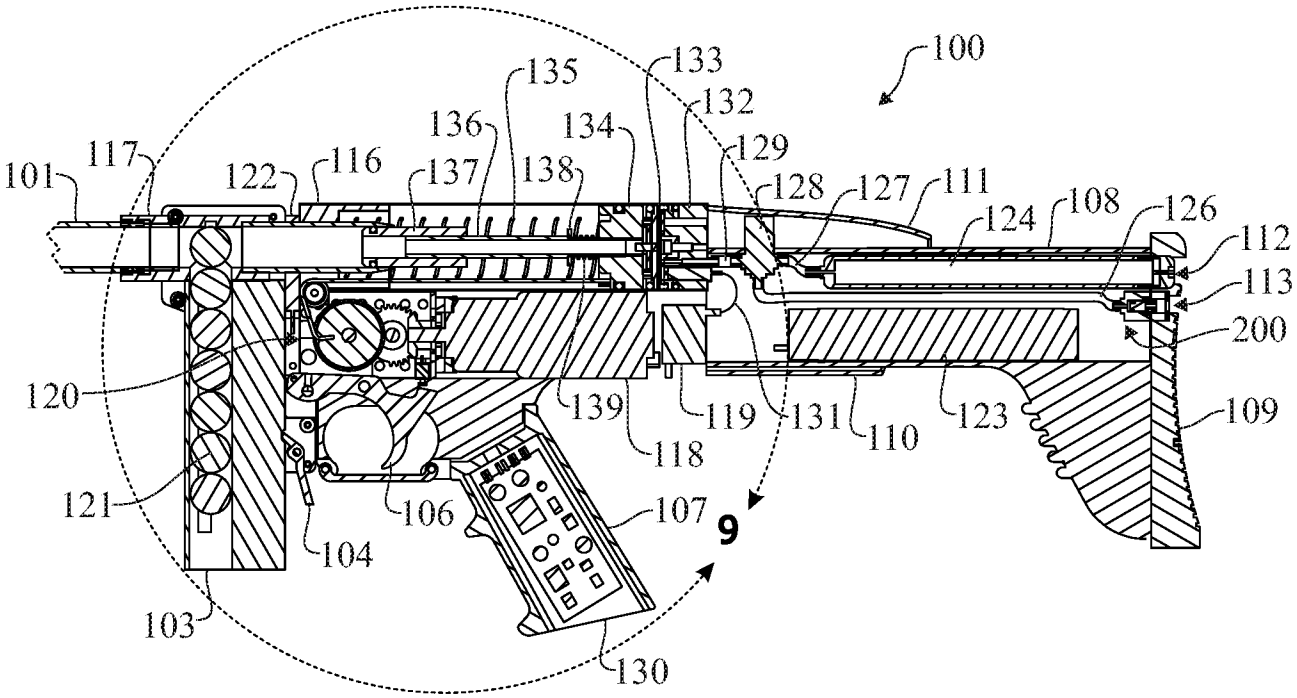
FIG. 8 shows a cross-sectional view along cross sectional plane 8-8 of FIG. 7, with a piston in an idle or initial position.

FIG. 8 shows a cross-sectional view of the marker 100 in the idle position. In this embodiment the buttstock 108 includes the internal green gas reservoir 124 which is connected to the 3-way solenoid valve 128 through a conduit 127. The conduit 129 connects the exit of the 3-way solenoid valve 128 to the green gas injection port 125 on the end cap 132. The adjustable volume reservoir 200 is also connected to the 3-way solenoid valve 128 through the conduit 126. FIG. 8 also shows that in this embodiment the battery pack 123 is located inside of the buttstock 108.

Figure 9:
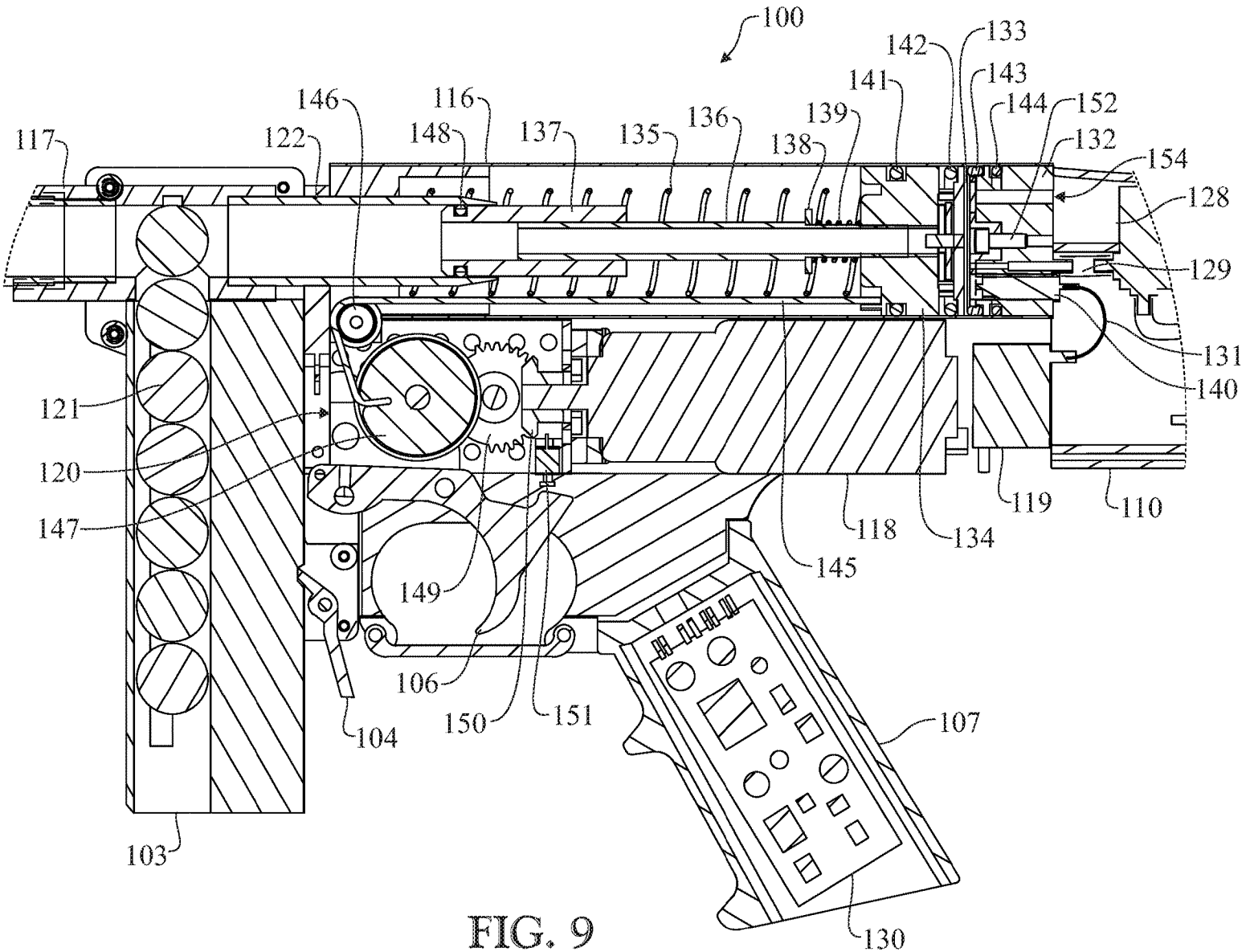
FIG. 9 shows a detail view of detail 9 indicated in FIG. 8.

FIG. 9 shows a detailed view of the marker 100 in the idle position.

The piston 134 is connected to the bolt 137 through a power tube 136. In the idle position, the return spring 135 is extended pressing the piston 134 against the double O-ring bumper 143.

Figure 18:
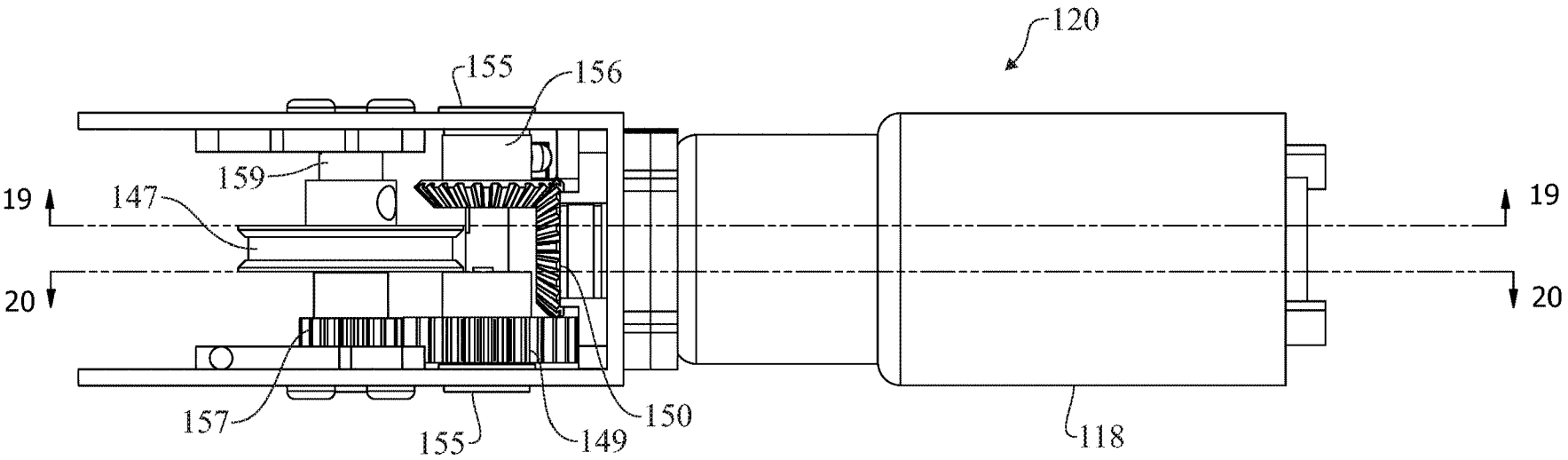
FIG. 18 shows a top view of the geared DC motor and gear box.
Figure 19:
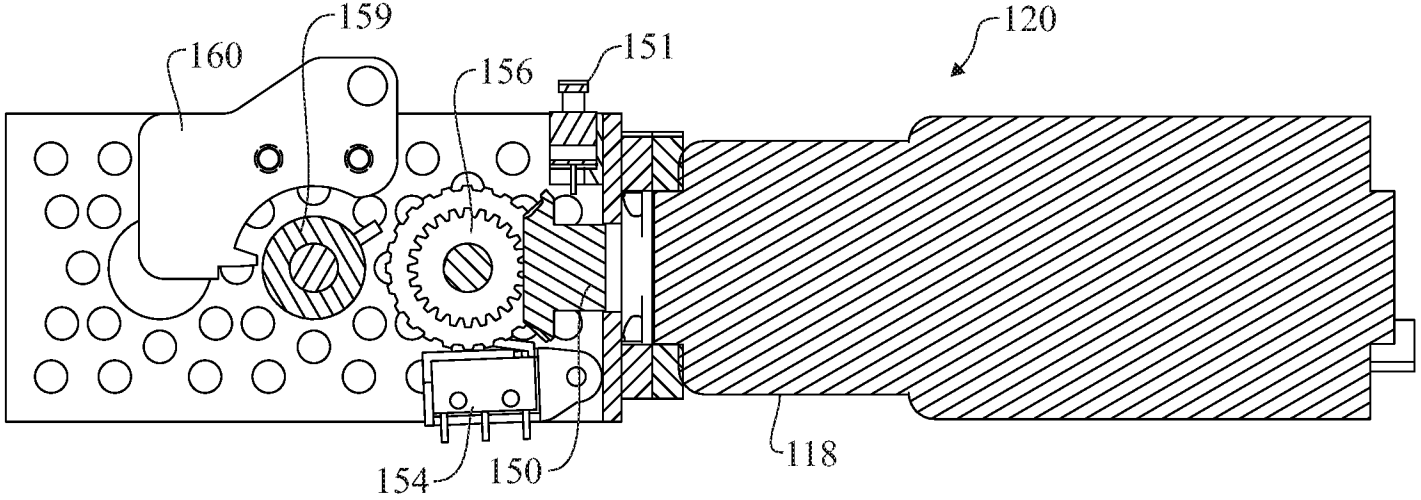
FIG. 19 shows a cross-sectional view of the geared DC motor and gear box, the cross section taken along plane 19-19 of FIG. 18.
Figure 20:
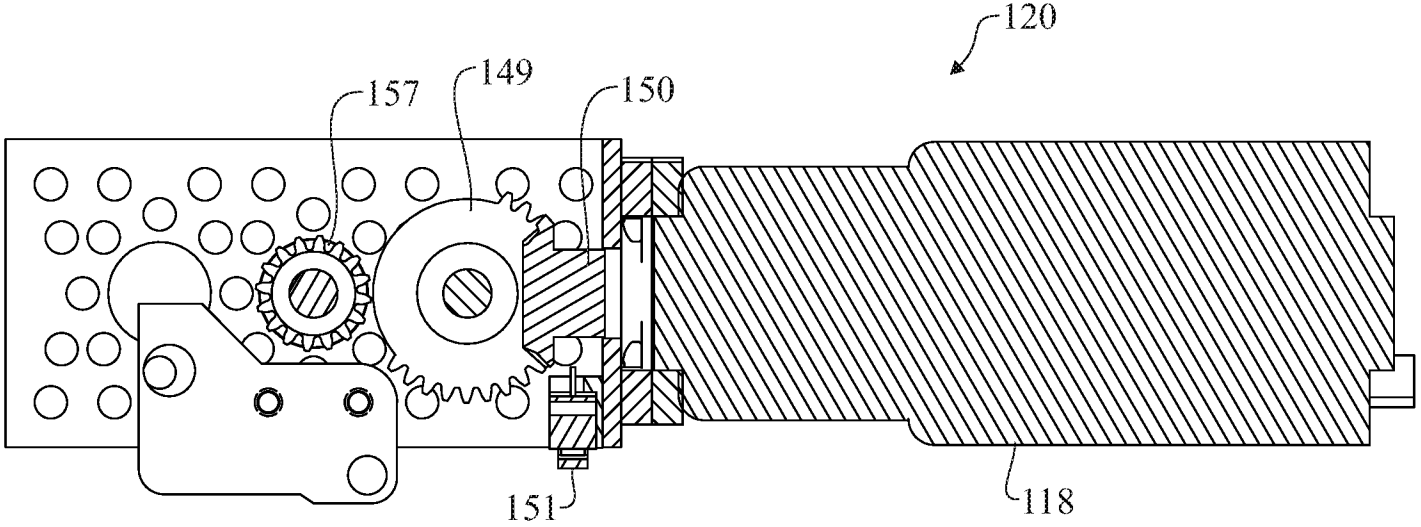
FIG. 20 shows a cross-sectional view of the geared DC motor and gear box, the cross section taken along plane 20-20 of FIG. 18.
Figure 21:
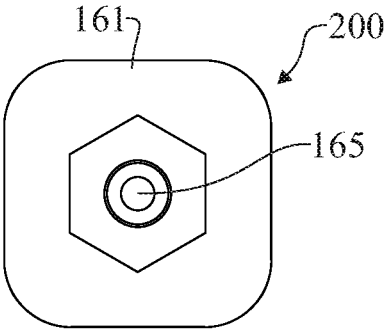
FIG. 21 shows a front view of the volume adjustable reservoir.

The spool 147 and the pinion gear (157 in FIG. 18) are brazed on the large pulley shaft 167 and turns counterclockwise by the action of the sector gear 149 on the pinion gear (157 in FIG. 18). In the idle position, the sector gear 149 is disengaged from the pinion gear (157 in FIG. 8) allowing the spool 147 to be pulled by the flexible shaft 145, which is connected to the piston 134, to an initial position that can be adjusted by setting the angle of the stopper 159 and the stopper plate 160. The return spring 135 thus causes the spool 147 and the flexible shaft 145 to be forced to their initial positions when they are not activated by the trigger assembly, since the return spring 135 forces the piston 134 backward. The flexible shaft 145 can be made from any kind of metal, plastic, fiber or resin and can be in the form of a cable, a chain, or any other format or structure that allows flexibility. This embodiment of the marker 100 shows a spool 147 attached to the flexible shaft 145, but in another embodiment it may be a chain and a sprocket or any combination of a flexible shaft and means to actuate it.

The projectile 121 is inside the receiver 117 and held in position by a ball retainer (not shown) to prevent it from rolling inside the bolt guide 122 or to the barrel.

Figure 10:
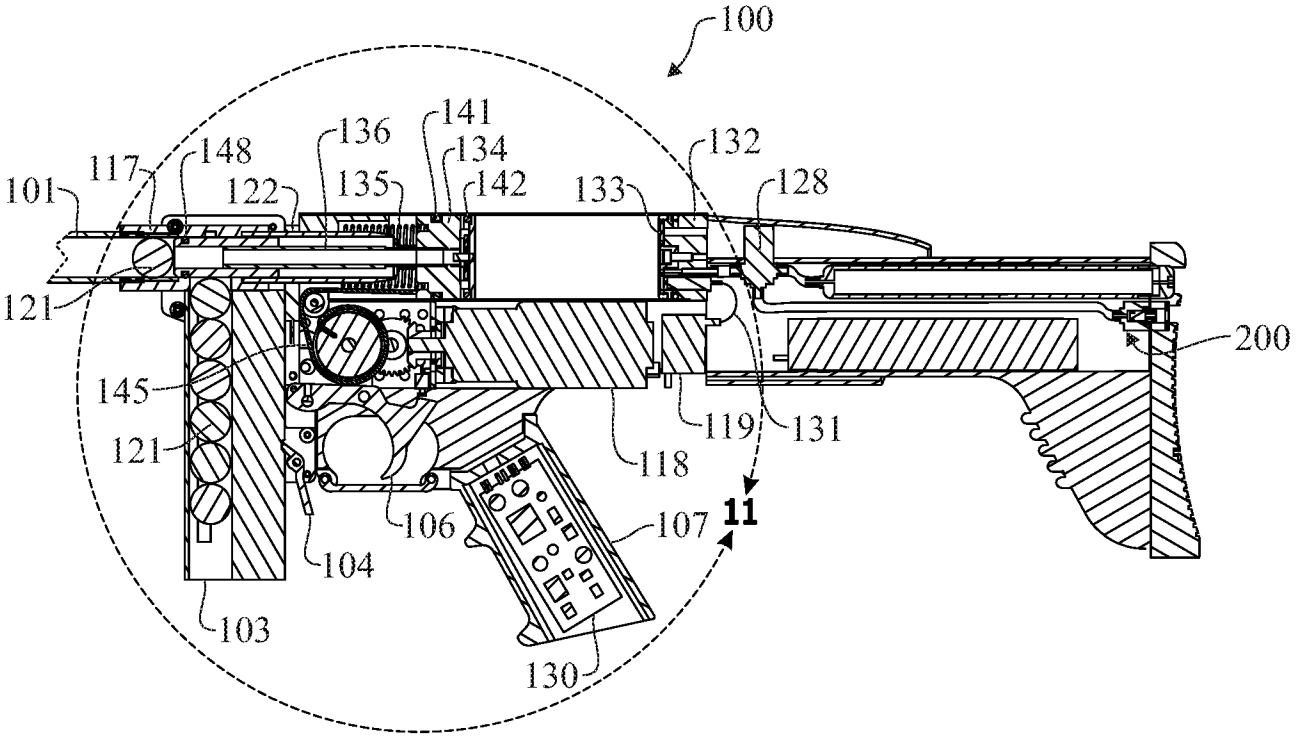
FIG. 10 shows a cross-sectional view of the embodiment of FIG. 1 in the shooting position, the cross section taken along cross-sectional plane 8-8 of FIG. 7.

FIG. 10 shows a cross-sectional view of the marker 100 in the shooting position.

Figure 11:
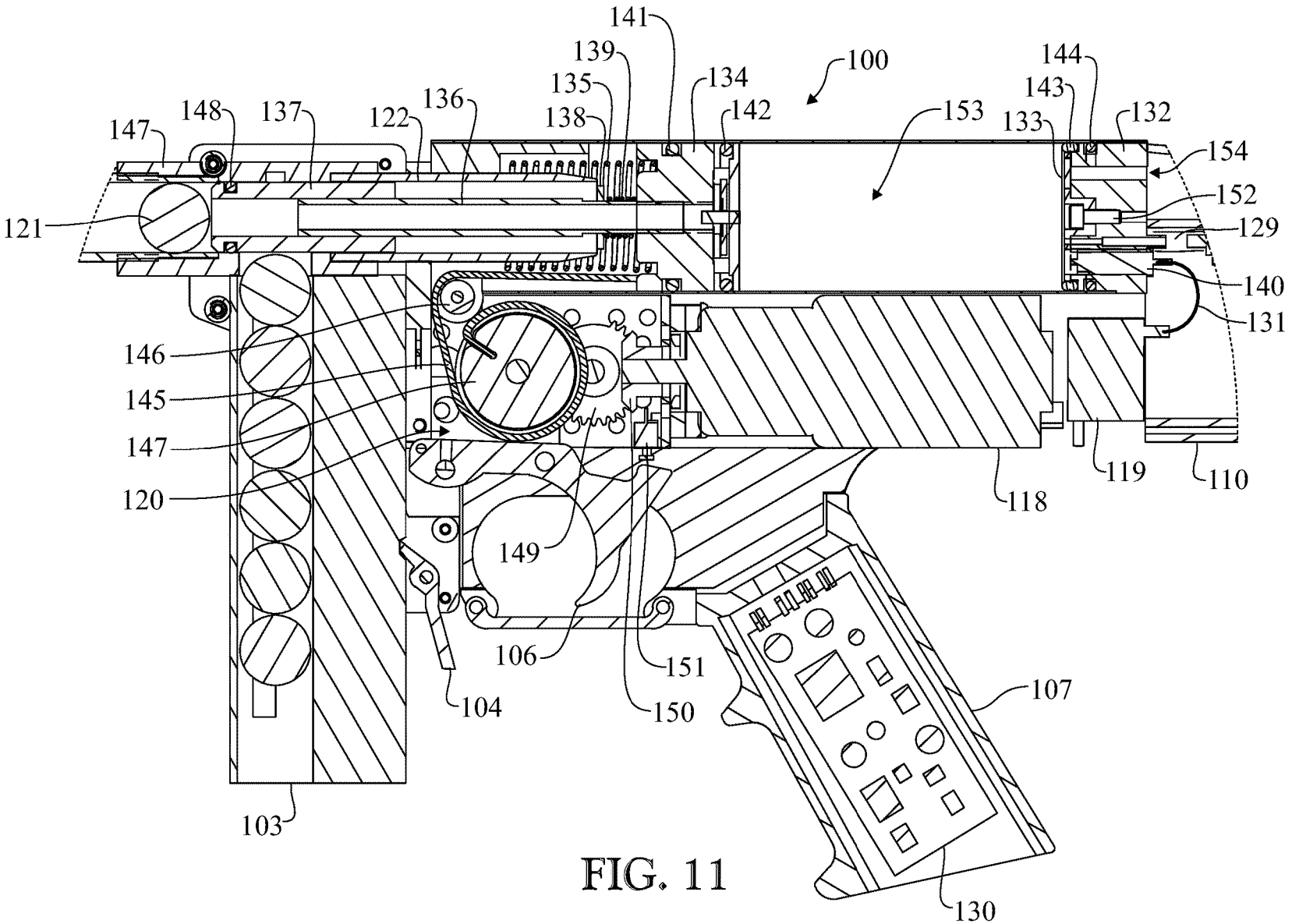
FIG. 11 shows detail view by way of detail 11 of FIG. 10.

FIG. 11 shows a detailed view of the marker 100 in the shooting position and the sequence of events to get from the idle position to the shooting position. The sequence starts when a user pulls the trigger 106 and the trigger switch 151 is activated informing the electronic circuit board 130 that the trigger is pulled.

Figure 17:
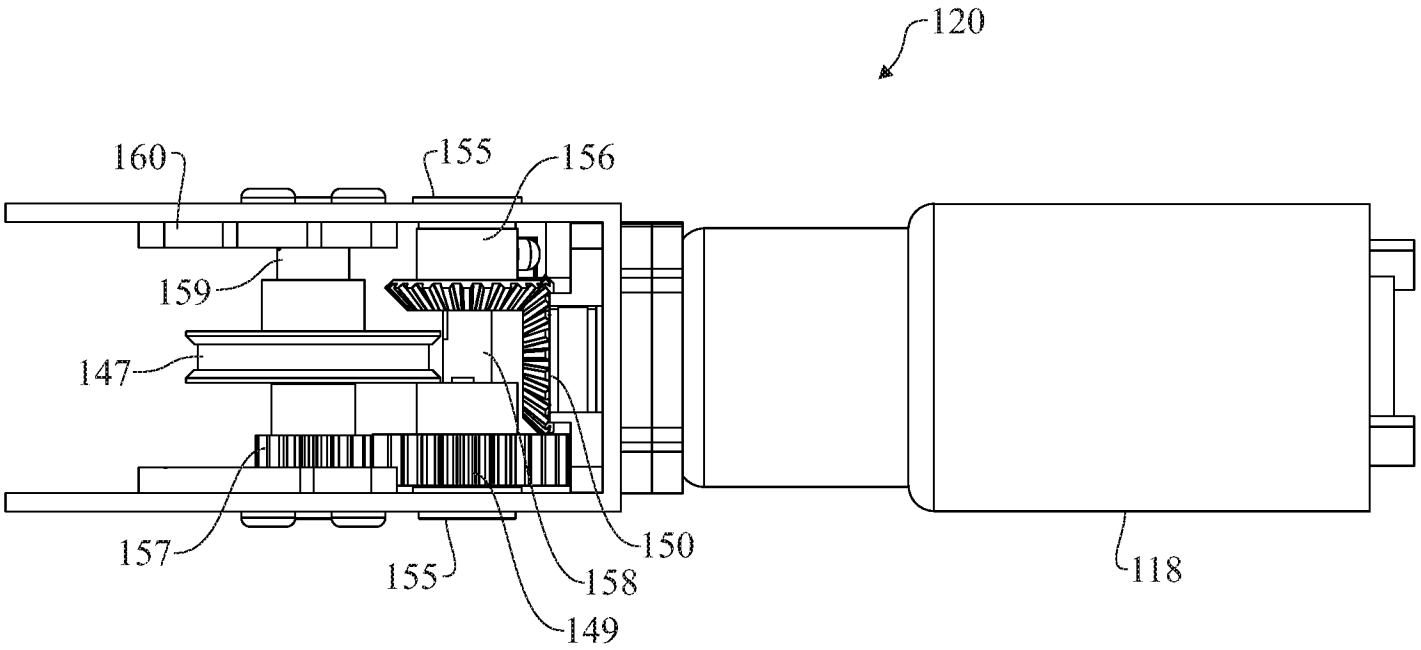
FIG. 17 shows a top view of the geared DC motor and gear box.

The electronic circuit board 130 sends an electrical pulse to the 3-way solenoid valve 128 which allows all the green gas trapped inside the volume adjustable reservoir 200 to go between the piston 134 and the end cap valve membrane 133. At the same time, the DC geared motor 108 is activated and starts to spin with the DC motor bevel gear 150 attached to its shaft. The DC motor bevel gear 150 is engaged to the bevel gear (156 in FIG. 17) which is brazed to the shaft 150. Also brazed to the shaft 150 is the sector gear 149, so when the DC geared motor 108 spins the sector gear 149 also spins and engages the pinion gear 157, which transfers the torque through the shaft 167 to the spool 147. The spool 147 starts to rotate counterclockwise spooling the flexible shaft 145 around the spool 147, and as a result the piston 134 is pulled towards the projectile receiver 117, compressing the spring 135 and creating the combustion chamber 153 to mix the green gas with air and later ignite it. The piston 134 has in the back side a one-way valve operated by the piston valve O-ring 142. When the piston 134 moves toward the projectile receiver 117, the piston valve blocks the air passage between the piston 134 and the power tube 136 resulting in a vacuum in the combustion chamber 153 which opens the end cap valve membrane 133 and sucks air through the main body air inlet 168 to inside the chamber 153 mixing with the green gas previously injected. The bolt which is attached to the piston 134 through the power tube 136 pushes the projectile 121 from the projectile receiver 117 to the barrel 101 and seals it with the bolt O-ring 148. The DC geared motor 108 and gear box 120 continue to spin and the bevel gear 156 activates the spark switch 154. With the spark switch 154 activated, the electronic circuit board 130 sends an electrical pulse to the high voltage unit 119 which generates high voltage and sends it through the high voltage cable 131 to the spark plug 140 igniting the mixture of the green gas and air inside the chamber 153 generating a pulse of pressure that pushes the piston valve O-ring 142 against the piston allowing passage of the combustion gases from the combustion chamber 153 to the power tube 136, propelling the projectile 121.

Figure 12:
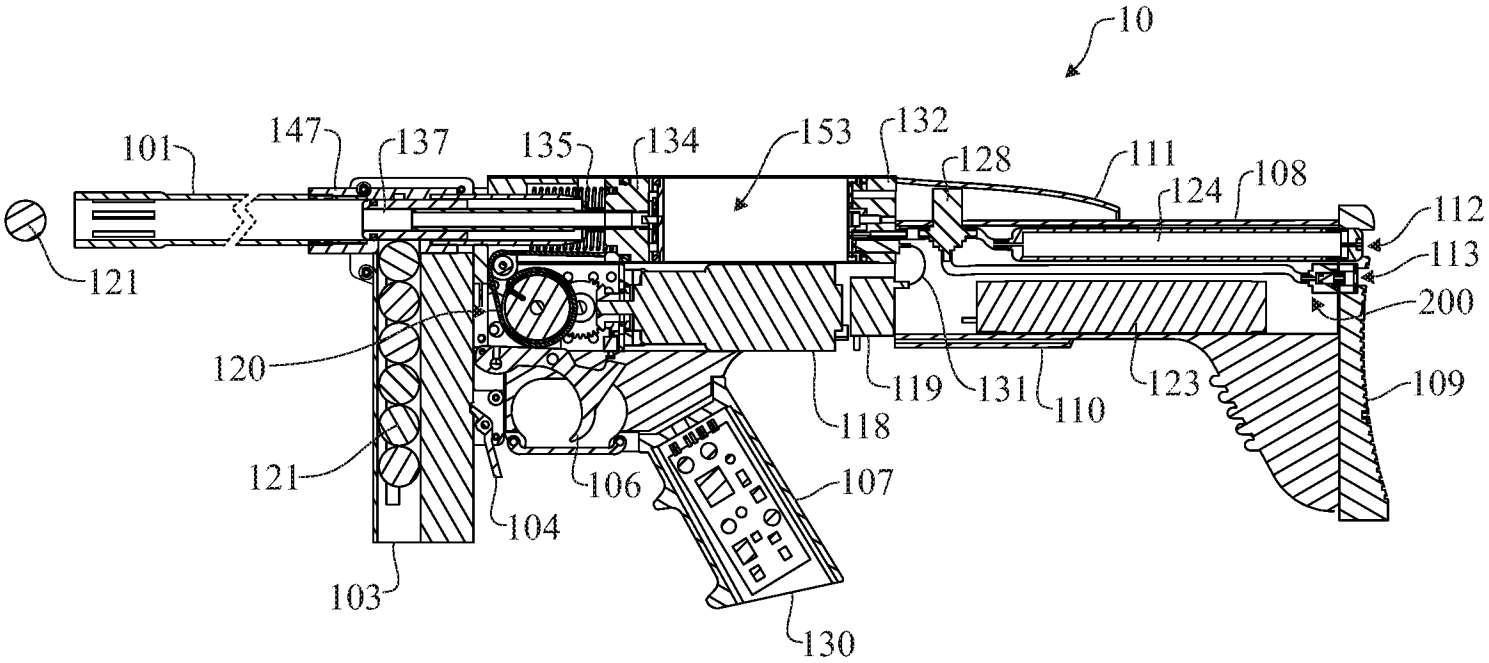
FIG. 12 shows a cross-sectional view of the embodiment of FIG. 1 after combustion with the projectile leaving the barrel, where the cross section is taken along plane 8-8 of FIG. 7.

FIG. 12 shows a cross-sectional view of the marker 100 when the projectile 121 leaves the barrel, after that the electronic circuit board cuts the power of the DC geared motor 108 after the sector gear 149 disengages from the pinion gear 157, the return spring 135 pushes the piston 134 back to an idle position to cause the remaining gases of the previous combustion are exhausted through the piston valve to the barrel 101 and as the piston 134 moves back it pulls the flexible shaft 145 unspooling it from the spool 147 and positioning the spool 147 on its initial or idle position.

Figure 13:
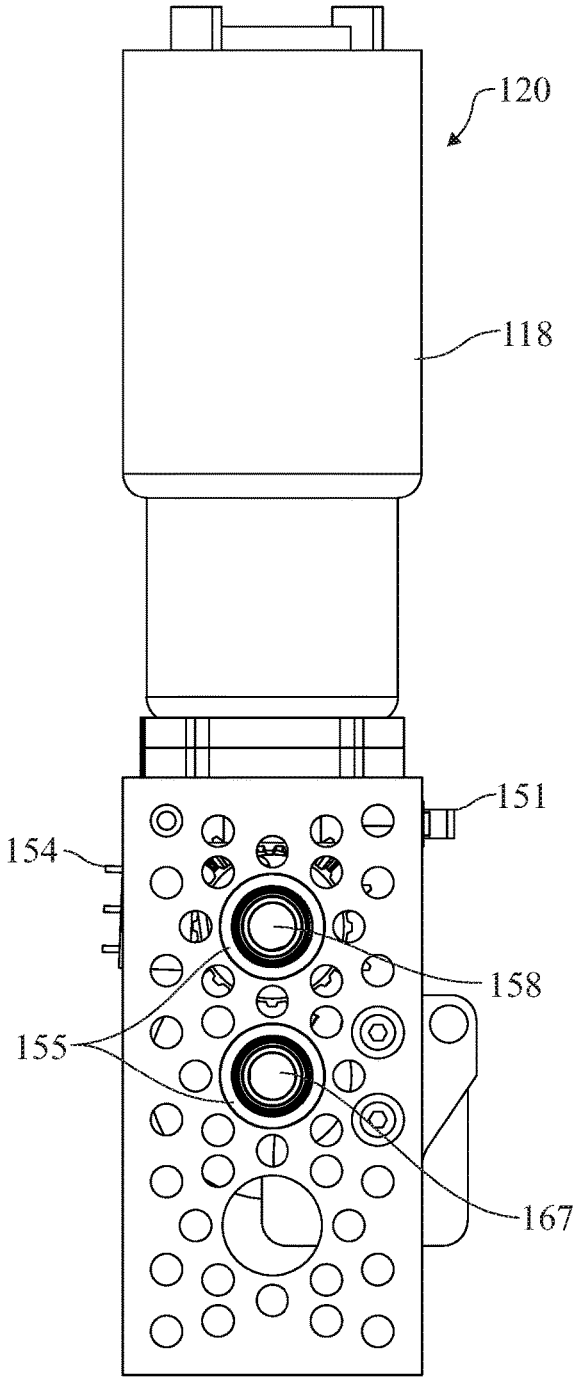
FIG. 13 shows a left side view of a geared DC motor and gear box.

FIG. 13 shows the left side view of the gear box assembly 120, the ball bearings 155, the shafts 158, and the large pulley shaft 167.

Figure 14:
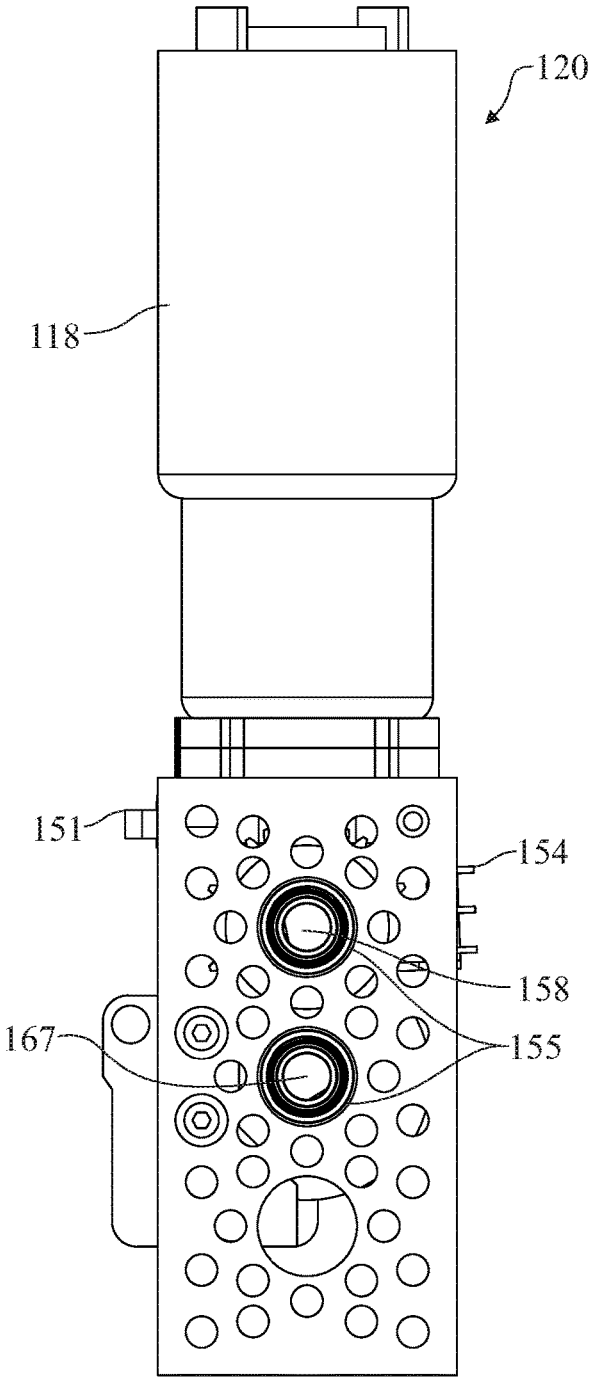
FIG. 14 shows a right side view of the geared DC motor and gear box.
Figure 15:
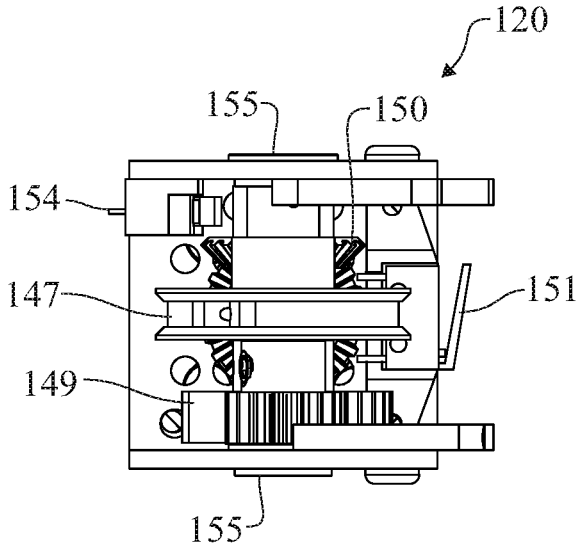
FIG. 15 shows a front view of the geared DC motor and gear box.
Figure 16:
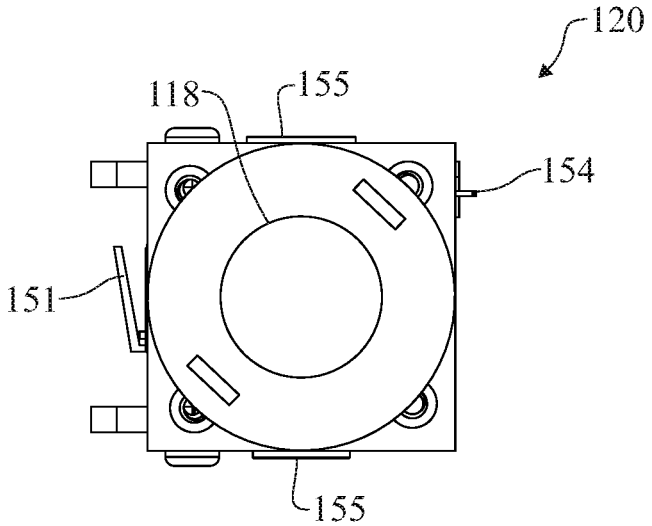
FIG. 16 shows a back view of the geared DC motor and gear box.

FIG. 14 shows the left side view of the gear box assembly 120, the ball bearings 155, the shafts 158, and the large pulley shaft 167.

FIGS. 15-23 have no additional description and are described in the brief description of drawings.

Figure 24:
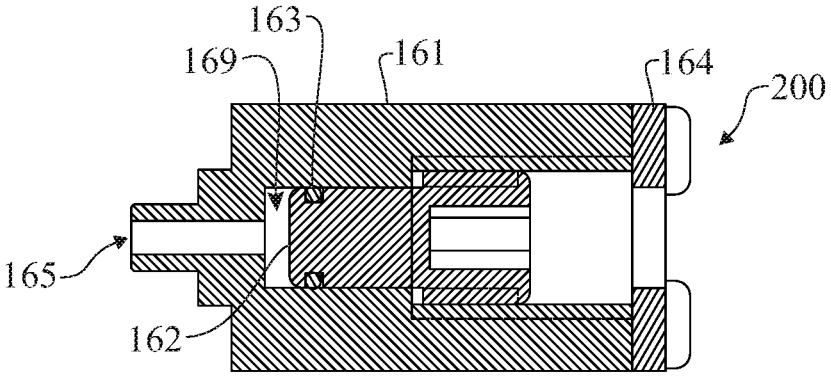
FIG. 24 shows a cross-sectional view of the volume adjustable reservoir, the cross section taken along plane 24-24 of FIG. 23.

FIG. 24 shows a cross-sectional view of the adjustable volume reservoir 200, and the reservoir volume adjusting screw 162 which with an Allen key can be turned clockwise to reduce the volume of the metering space 169 or turned counterclockwise to increase the volume of the metering space 169. Changing the volume of the metering space will regulate the amount of green gas that will be injected in the chamber 153 by the 3-way solenoid valve 128 when it is activated, eliminating the need for the gas pressure regulator in the marker 100.

It is to be understood that the disclosed marker is not limited to requiring green gas, and any appropriate combustible gas may be used.

In conclusion, the disclosed marker includes an internal combustion gas tank that is refillable by simply connecting a refill tank to an inlet. The marker may be configured to use green gas as a combustible gas. A flexible shaft is configured to pull a piston toward a barrel to load a projectile into the barrel and pull or allow green gas into a combustion chamber behind the piston. While the piston is in the forward position, the green gas is ignited creating a pulse of pressure to cause the projectile to shoot out of the barrel. After the shot, the combustion chamber collapses due to a spring that biases the piston to a backward position, after the flexible shaft is released from pulling the piston forward. Collapsing the chamber causes combusted hot gas to release through the barrel, or a front portion, of the marker. The main body has an opening at a front side that allows air to flow through the main body, especially after a shot, to allow exhaust to exit through the front opening (e.g. through the barrel).

The use of a flexible shaft and spool moves the piston, allowing the marker to be short and compact, while allowing the marker to use combustion. The piston "collapses" the combustion chamber after each shot to keep the temperature of the chamber low, by exhausting remaining hot gases right after each shot. On the back side of the main body (tube) there is a closed end cap, but the front is always open to allow circulation of air to cool the main body. The combustion chamber is collapsed by a spring until the trigger is pulled to cause the piston to move to a shooting position and create or expend the combustion chamber for receiving combustion gas inside the combustion chamber. The piston is moved to a shooting position assisted by a DC, step, or servo motor that operates the flexible shaft. The piston is moved to a shot position, pulled by a flexible means such as a flexible shaft, cable, or any appropriate flexible, long, and thin structure. The spool winds the flexible shaft and the spool is operated by a motor that applies torque to the spool. The combustion chamber "collapses" immediately after shooting for cooling. The gearbox and motor is mounted parallel to the main body. A 3 way solenoid valve is configured to inject the green gas into the combustion chamber that is created by the motioned piston. The back portion of the piston has a one way valve. The gearbox may use a sector gear to rotate a spool to wind the flexible shaft that moves the piston forward. The marker may use an internal rechargeable battery pack or any appropriate electrical power source. The piston has a one way valve that opens automatically when the piston is returning to the idle position to force hot gas to escape forward through the piston's one way valve. The piston valve closes automatically when the piston is moved to the shooting position to cause a vacuum and pull combustion gas into the combustion chamber. The piston valve may open automatically when the combustion occurs to send a pulse of air through the piston for propelling the projectile.

Green gas may be an odorless gas that has been mixed with silicone oil. It may be a low-pressure propellant that develops about 115 psi. Green gas may be, or may include, propane, and/or one or more lubricants.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A projectile launcher, comprising:

an internal tank configured to receive a combustible gas through an inlet;

a barrel;

a projectile storage portion;

a piston;

a trigger assembly configured to operate a spool;

a flexible structure configured to wrap around the spool, the flexible structure being connected to the piston;

wherein pulling the trigger assembly causes the spool to rotate to cause the flexible structure to pull the piston forward;

wherein the piston is configured to expand a combustion chamber behind the piston when pulled forward;

wherein pulling the trigger assembly causes the combustible gas to enter the combustion chamber created by the piston moving forward;

wherein pulling the piston forward loads a projectile into the barrel from the projectile storage portion in response to pulling the trigger assembly;

wherein gas in the combustion chamber is ignited while the piston is pulled forward, and igniting the gas causes a pulse to travel through the piston for executing a shot by launching the projectile through the barrel;

wherein the combustion chamber is configured to collapse after the shot is executed due to a spring bias applied to the piston to a backward position and due to the flexible structure being released from pulling the piston forward; and wherein collapsing the combustion chamber causes hot gas generated from the shot to be released.

2. The projectile launcher of claim 1, wherein the gas is green gas.

* * * * *